US006634326B2

(12) United States Patent
Radel et al.

(10) Patent No.: US 6,634,326 B2
(45) Date of Patent: Oct. 21, 2003

(54) TWO-STROKE MOTOR WITH FRESH-GAS SUPPLY AND FLANGE FOR A TWO-STROKE MOTOR

(75) Inventors: Harry Radel, Geesthacht (DE); Rainer Massmann, Hamburg (DE)

(73) Assignee: Dolmar, GmbH, Hamburg (DE)

( * ) Notice: Subject to any disclaimer, the term of this patent is extended or adjusted under 35 U.S.C. 154(b) by 0 days.

(21) Appl. No.: 10/010,751

(22) Filed: Dec. 6, 2001

(65) Prior Publication Data

US 2002/0088412 A1 Jul. 11, 2002

(30) Foreign Application Priority Data

Dec. 6, 2000 (DE) ..... 200 20 655 U

(51) Int. Cl.[7] ..... F02B 33/04
(52) U.S. Cl. ..... 123/73 PP; 123/73 A
(58) Field of Search ..... 123/73 PP, 73 A, 123/73 B, 73 C, 73 R, 73 AA, 65 A, 65 P, 65 V, 65 R, 65 S, 65 W, 73 V, 65 PD, 305, 65 VC, 184.46

(56) References Cited

U.S. PATENT DOCUMENTS

| | | | | |
|---|---|---|---|---|
| 6,101,991 A | | 8/2000 | Glover | 123/73 PP |
| 6,112,708 A | * | 9/2000 | Sawada et al. | 123/73 PP |
| 6,367,432 B1 | * | 4/2002 | Araki | 123/73 R |

FOREIGN PATENT DOCUMENTS

| | | | |
|---|---|---|---|
| EP | 0997621 A1 | 5/2000 | F02B/17/00 |
| EP | 0997623 A1 | 5/2000 | F02B/25/14 |
| EP | 1006267 A1 | 6/2000 | F02B/33/44 |

OTHER PUBLICATIONS

MTZ Motortechnischen Zeitshrift 74 (1972) 12, pp. 475–479 (in German).

* cited by examiner

*Primary Examiner*—Henry C. Yuen
*Assistant Examiner*—Hyder Ali

(57) ABSTRACT

The invention relates to a two-stroke motor with a fresh-gas supply (preferably with oil-in-gasoline lubrication), with a motor housing in which a crank chamber with an inlet opening and a cylinder chamber with an outlet opening are formed, with a crank drive in the crank chamber and with a piston in the cylinder chamber that are connected to one another by a connecting rod, with at least one overflow conduit, with a carburetor comprising a carburetor chamber with a fresh-air entrance opening, a fuel entrance opening and a mixture exit opening as well as comprising a throttle flap that can move in a regulatable manner, with an inlet conduit in order to connect the mixed outlet opening of the carburetor chamber to the inlet opening of the crank chamber, and with a fresh-gas conduit that empties through an opening into the overflow conduit in order to supply fresh gas to the overflow conduit. The invention also entails a flange for a two-stroke motor with fresh-gas supply, especially for a two-stroke motor with oil-in-gasoline lubrication.

22 Claims, 3 Drawing Sheets

TWO-STROKE MOTOR WITH FRESH-GAS SUPPLY AND FLANGE FOR A TWO-STROKE MOTOR

FIELD OF THE INVENTION

This application claims priority from Federal Republic of Germany application 200 20 655.9, and the entire contents of same are incorporated herein by reference.

The invention relates to a two-stroke motor with a fresh-gas supply, preferably with oil-in-gasoline lubrication. The invention relates to a two-stroke motor with a fresh-gas supply (preferably with oil-in-gasoline lubrication), with a motor housing in which a crank chamber with an inlet opening and a cylinder chamber with an outlet opening are formed, with a crank drive in the crank chamber and with a piston in the cylinder chamber that are connected to one another by a connecting rod, with at least one overflow conduit, with a carburetor comprising a carburetor chamber with a fresh-air entrance opening, a fuel entrance opening and a mixture exit opening as well as comprising a throttle flap that can move in a regulatable manner, with an inlet conduit in order to connect the mixed outlet opening of the carburetor chamber to the inlet opening of the crank chamber, and with a fresh-gas conduit that empties through an opening into the overflow conduit in order to supply fresh gas to the overflow conduit. The invention also entails a flange for a two-stroke motor with fresh-gas supply, especially for a two-stroke motor with oil-in-gasoline lubrication.

BACKGROUND OF THE INVENTION

Two-stroke motors are known. The operating principle of a two-stroke motor with a fresh-air supply is described in the MTZ Motortechnischen Zeitschrift 74 (1972) 12, p. 475. The fresh-air supply causes the loss of the noxious air-fuel mixture through the outlet opening of the cylinder chamber, which in turn causes the hydrocarbon emissions of the two-stroke motor to be low. Since only a small part of the air-fuel mixture is expelled unburned out of the cylinder chamber, the two-stroke motor with the fresh-air supply is not only environmentally friendly but saves fuel at the same time. However, the realization of the fresh-air supply has the disadvantage that the design of the two-stroke motor with a fresh-air supply is expensive. Furthermore, the fresh air supplied adversely affects the synchronization property of the two-stroke motor, especially at low speeds.

EP 0 997 623 A1 discloses a two-stroke motor with mixed scavenging and with a suction device that comprises a carburetor and by means of which suction device cold fresh gas from the carburetor is placed at a slight interval from a mouth of an overflow conduit into a cylinder chamber. The fresh gas serves to cool the inner cylinder wall and the piston bottom. The disclosed two-stroke motor has the significant disadvantage that the placed fresh gas comprises an air-fuel mixture. The two-stroke motor therefore puts hydrocarbon compounds into the environment.

EP 0 997 621 A1 discloses a two-stroke motor with mixed scavenging in which a carburetor is arranged between an air filter and an inlet conduit to a crank chamber. A mixture conduit and a fresh-air conduit are formed in the carburetor that is connected to the inlet conduit and to an overflow conduit. A first throttle flap for controlling the mixture volume flowing through is fixed in the mixture conduit; a second throttle flap for controlling the volume of fresh air flowing through is fixed in the fresh-air conduit. The mixture volume flowing through and the fresh-air volume flowing through are controlled independently of one another in the disclosed two-stroke motor. However, the design of the carburetor of the two-stroke motor requires many components and is very expensive; furthermore, the control of the mixture volume flowing through and the control of the fresh-air volume flowing through must be coordinated with one another, which necessitates an additional operating expense.

U.S. Pat. No. 6,101,991 discloses a two-stroke motor with mixed scavenging and with a cylinder chamber and a crankcase. The two-stroke motor comprises an inlet conduit in order to supply an air-fuel mixture to the crankcase. A throttle flap is provided in order to throttle the air flow through the inlet conduit and a carburetor is provided for delivering fuel into the inlet conduit. The interior of the crankcase is subdivided into at least two crankcase volumes separate from one another: A rich volume and a lean volume. Each crankcase volume communicates with the cylinder chamber through an associated opening in the cylinder wall. Furthermore, a lateral opening between an outlet opening and a rear overflow opening is formed in the cylinder wall in such a manner that it is freed before the outlet opening is closed. This lateral opening communicates with the lean volume by means of a lateral overflow conduit. The rear opening communicates with the rich volume. A section of the inlet conduit is subdivided into two inlet lines: A rich line and a lean line that communicate with the rich volume and the lean volume. The carburetor and the throttle flap are designed and arranged in such a manner that upon a high load substantially the entire fuel delivered from the carburetor passes into the rich line. Upon a small load the fuel delivered by from the carburetor passes into both lines, into the rich line as well as into the lean line. This known two-stroke motor has the disadvantage that in the crankcase the separation of the rich volume from the lean volume can only be achieved in an expensive and incomplete manner if, e.g., only a disk-shaped flywheel functions as a separating wall. The flywheel increases the weight of the two-stroke motor and as a result of the device into which the two-stroke motor is installed. Furthermore, the flywheel causes an especially large angular momentum whose change of adjustment requires an especially large amount of force upon a corresponding movement of the two-stroke motor. If a hand-held device is involved, the operating of the hand-held device therefore becomes particularly difficult.

EP 1 006 267 A1 discloses a two-stroke motor with mixed scavenging that comprises overflow conduits, each of which communicates with a fresh-air conduit. The mouths of the overflow conduits into the cylinder chamber are arranged in such a manner that the reduction of pressure in the crank chamber after an upward movement of a piston makes it possible to draw air out of the lateral fresh-air conduits into the overflow conduit. If the piston is at top dead center the mouths are located below the piston in free communication with the crank chamber. This construction prevents mixture from being located in the mouth area of the overflow conduits at the start of a scavenging process which mixture is expelled through the outlet opening. However, this construction also has the disadvantage that the fresh air is not supplied in a manner independent of the speed.

SUMMARY OF THE INVENTION

The invention has the task of creating a two-stroke motor of the initially described type that avoids the cited disadvantages, in particular has the simplest possible design and emits as few pollutants as possible during operation.

The invention solves this problem with a two-stroke motor with a fresh-gas supply, especially with a two-stroke motor with oil-in-gasoline lubrication, with a motor housing in which a crank chamber with an inlet opening and a cylinder chamber with an outlet opening are formed, with a crank drive in the crank chamber and with a piston in the cylinder chamber that are connected to one another by a connecting rod, with at least one overflow conduit, with a carburetor comprising a carburetor chamber with a fresh-air entrance opening, a fuel entrance opening and a mixture exit opening as well as comprising a throttle flap that can move in a regulatable manner, with an inlet conduit in order to connect the mixed outlet opening of the carburetor chamber to the inlet opening of the crank chamber, and with a fresh-gas conduit that empties through an opening into the overflow conduit in order to supply fresh gas directly to the overflow conduit, characterized in that the fresh-gas conduit and the carburetor chamber communicate with one another in such a manner that the throttle flap acts in a regulatable manner on the direct supply of fresh gas to the overflow conduit.

The invention creates a two-stroke motor with a regulatable fresh-gas supply with an especially simple design. In particular, a fuel component of the fresh-gas supply can be regulated. In the two-stroke motor of the invention the regulating of the fresh-gas supply takes place in a speed-dependent manner. In this way the performance of the two-stroke motor can be optimized as a function of the speed. The fuel consumption and the emitting of pollutants of the two-stroke motor with optimized performance are particularly low. The two-stroke motor of the invention can be operated in an especially environmentally friendly manner.

DETAILED DESCRIPTION OF THE PREFERRED EMBODIMENTS

Figure 1:
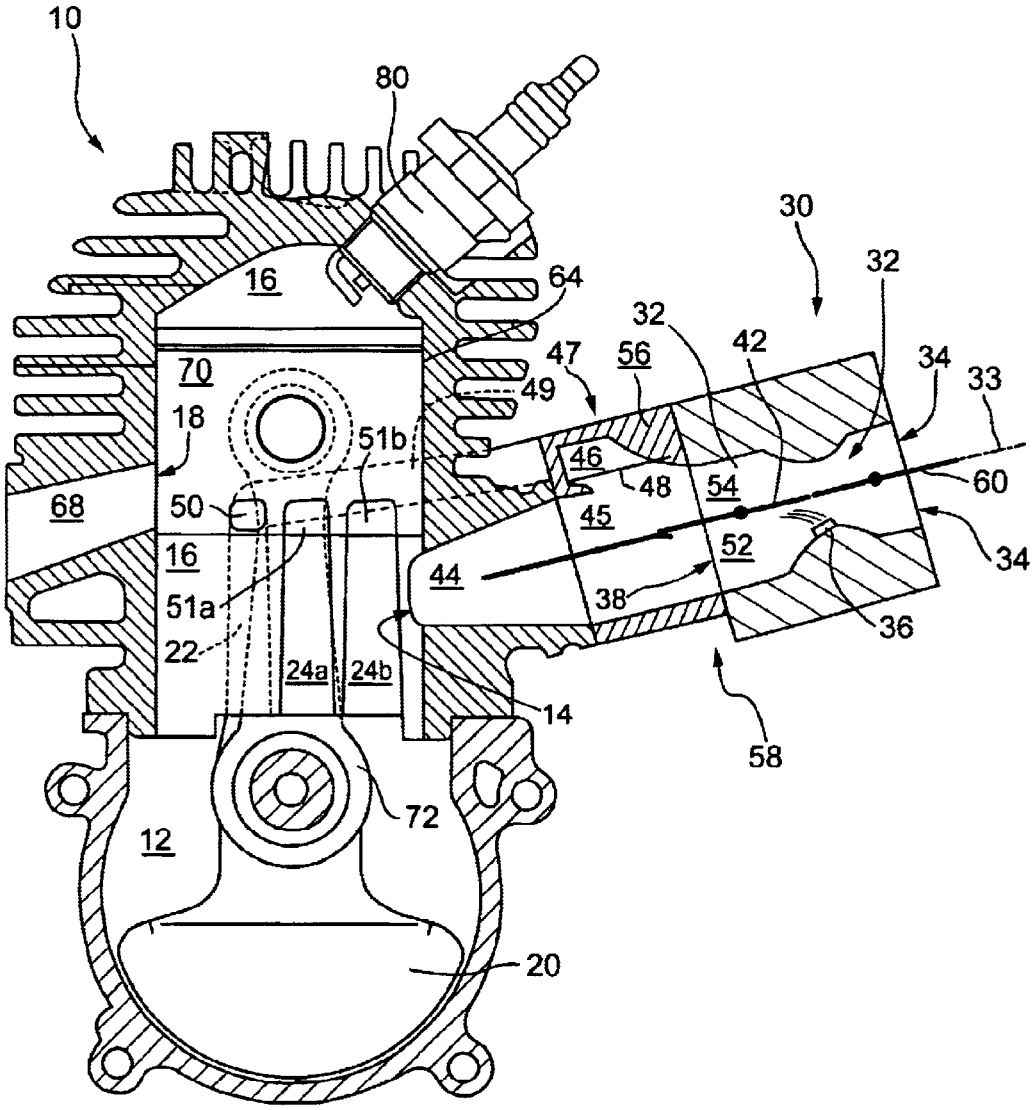
FIG. 1 shows a sectional lateral view of a two-stroke motor in accordance with a first exemplary embodiment.

In the two-stroke motor of the invention fresh air is drawn in through the fresh-air entrance opening into the carburetor chamber during the suction stroke. At the same time a mixture of fuel, to which a little lubricating oil was preferably added, enters through the fuel entrance opening into the carburetor chamber and is mixed in a first volume section with the fresh air so that an air-fuel mixture is produced in the carburetor chamber. The formation of the first volume section is a function of the position of the throttle flap. The air-fuel mixture is drawn essentially through the mixture exit opening, the inlet conduit and the inlet opening into the crank chamber. A second volume section of fresh air is drawn through the mixture exit opening of the carburetor chamber, through the fresh-gas conduit and the opening to the overflow conduit into the overflow conduit and supplied there to the cylinder chamber.

The throttle flap is advantageously arranged in the area of the mixture exit opening for the air-fuel mixture. In this arrangement an exchange downstream from the throttle flap between the first volume section with the air-fuel mixture and the second volume section with the fresh air is especially low in the carburetor chamber when the throttle flap is set at fully open. In one embodiment at least one separating element is arranged in such a manner in the carburetor chamber that it supports the separating action of the throttle flap in the first open position. The separating element is arranged upstream from the throttle flap and/or in the area of the throttle flap and/or downstream from the throttle flap.

In one embodiment the carburetor is designed as a membrane carburetor. A preferred embodiment comprises a non-return valve that closes the connection between the carburetor chamber and the overflow conduit when the pressure on the side of the non-return valve which side faces the opening to the overflow conduit exceeds the pressure on the side facing the carburetor chamber or is equal to the latter. The non-return valve prevents waste gas out of the cylinder chamber from forcing the fresh gas out of the fresh-gas conduit back into the carburetor. The non-return valve is designed especially preferably as at least one leaf spring whose intrinsic tension is minimized in a closing position. As a result of this intrinsic tension the leaf spring is placed in the closing position when the pressure is equally great on both sides of the leaf spring so that the non-return valve is closed. In one embodiment the leaf spring is arranged in such a manner that it forms essentially a wall section of the inlet conduit in the closed position. In another embodiment the leaf spring is arranged in the fresh-gas conduit in the area of the opening to the overflow conduit.

The opening in the overflow conduit is preferably formed at the level of the same axial cylinder section as the mouth of the overflow conduit into the cylinder chamber. In this embodiment the supply of fresh gas is optimized since the fresh gas is supplied practically directly to the mouth of the overflow conduit so that the entire conduit volume can be filled.

In one embodiment of the two-stroke motor of the invention the throttle flap can be brought into a first open position in which the throttle flap is fully open. In this position of the throttle flap a right-angled cross section through the carburetor chamber to a longitudinal axis of the carburetor chamber is largely freed. In the first position the throttle flap separates the carburetor chamber along the longitudinal axis at least partially into a mixing chamber section with the fuel entrance opening and into a remaining fresh-air chamber section. The mixing chamber section receives the volume section with the fresh air that is mixed with the fuel to the air-fuel mixture. The fresh-air chamber section receives the volume section of fresh air that is supplied at least partially through the fresh-gas conduit to the overflow conduit. In this position of the throttle flap the fresh-gas supply comprises essentially only fresh air, for which reason the emission of pollutants is very low.

The throttle flap can be brought in an especially preferred manner into at least a second open position in such a manner that the separation of the mixing chamber section from the fresh-air chamber section is reduced the more the second open position of the throttle flap approaches a closed position. In this embodiment of the invention an especially large amount of fresh air is supplied, as explained above, when the throttle flap is wide open. Therefore, at maximum performance the relative emission of noxious hydrocarbon compounds is minimized. As the position of the throttle flap approaches the closed position the fresh-air component of the fresh-gas supply becomes less and the fuel component of the fresh-gas supply becomes greater. Therefore, the influence of the fresh air on the running properties, especially on the synchronization property, of the two-stroke motor becomes less the further the throttle flap is closed. The influence of the fresh air is thus especially low in the operating range of the two-stroke motor, namely, in the low-speed range, in which the influence would make itself noticeable in an especially disturbing manner.

One embodiment of the two-stroke motor of the invention comprises a flange connected in the area of the inlet opening to the motor housing. The carburetor with the exit opening is connected to the side of the flange opposite the motor housing. A conduit segment for connection to the inlet conduit and a branch conduit for connection to the fresh-gas conduit are formed in the flange. The flange is simple to manufacture and can be optionally installed in a traditional two-stroke motor, e.g., as a part of a retrofitted construction unit, in order to obtain a two-stroke motor with low emission of pollutants by means of the retrofitted construction unit. The retrofitted construction unit preferably comprises, in addition to the flange, a fresh-gas conduit with a non-return valve provided for connection to an overflow conduit. In one embodiment the non-return valve is arranged in the fresh-gas conduit directly in front of the opening to the overflow conduit.

A section of a conduit wall advantageously separates the branch conduit from the conduit segment in such a manner that the throttle flap of the carburetor strikes the section of the conduit wall when the carburetor is connected to the flange and the position of the throttle flap has approached a fully open position. In this arrangement an exchange downstream from the throttle flap between the first volume section with the air-fuel mixture and between the second volume section with the fresh air is minimized since the conduit wall continues the separation, undertaken by the throttle flap, of the first volume section with the air-fuel mixture from the second volume section with the fresh air.

A preferred embodiment comprises a starter flap arranged in the area of the fresh-air entrance opening. The starter flap can be adjusted in such a manner that when it is in a fully open position it is essentially in a plane with the throttle flap when the throttle flap assumes the first open position. The supply of fresh air can be controlled with the starter flap. When the two-stroke motor has become warm after the start the starter flap is brought into the fully open position. The starter flap forms in this position upstream a continuation of the separating wall formed by the throttle flap in the first position between the mixing section and the fresh-air section of the carburetor chamber.

In one embodiment of the invention the overflow conduit empties in the vicinity of the outlet opening of the cylinder chamber into the cylinder chamber. This embodiment has the advantage that the fresh gas passes on the one hand at first into the cylinder chamber and scavenges the cylinder chamber in a known manner before it is thrust through the exit opening into the ambient. In this embodiment a cooling of the cylinder wall and of the piston bottom is maximized. A special advantage resides additionally in the fact that low-pollutant fresh gas passes at first into the ambient if a short-circuit-like transition of fresh gas from the mouth of the overflow conduit to the exit opening occurs.

In an especially preferred embodiment the overflow conduit is formed by a pair of overflow lines designed symmetrically to one another. In this embodiment of the invention the scavenging of the cylinder chamber is especially effective. Accordingly, the fresh-gas conduit is formed by a pair of fresh-gas lines, each of which is associated with an overflow line. In an advantageous further development of the previously cited embodiment the overflow lines are designed in a hook-like manner, as a result of which the air-fuel mixture from the crank chamber scavenges the cylinder chamber in an especially effective manner on account of the flow and the unavoidable scavenging losses consist only of the air present in the fresh-gas supply. The lines function as storage chambers with a defined volume without mixing.

In one embodiment at least one second overflow conduit is provided. The second overflow conduit is formed by a second pair of overflow lines that are designed symmetrically to one another, connect the crank chamber to the cylinder chamber and empty at some distance to the outlet opening into the cylinder chamber. In this embodiment in the case of an appropriate arrangement of the openings of the overflow lines of the second overflow conduit as well as, optionally, of the openings of the overflow lines of further overflow conduits in the inner wall of the cylinder chamber those volume sections of the cylinder chamber that are to a certain extent in a dead area are cleared of waste gas because the fresh-gas mixed currents and air-fuel currents from the first overflow conduit run past them. In a preferred embodiment the second overflow conduit as well as, optionally, other overflow conduits are isolated from the carburetor, in contrast to the first overflow conduit, so that no fresh gas is supplied directly from the carburetor to the second overflow conduit or to other overflow conduits. This assures a smooth running.

The invention furthermore solves the problem by a flange for a two-stroke motor with fresh-gas supply, especially for a two-stroke motor with oil-in-gasoline lubrication in accordance with the invention with a first conduit segment that extends through the flange and comprises an entrance opening in a first front surface of the flange and an exit opening in a second front surface of the flange, which flange is provided in the area of the first front surface for fastening a carburetor to the flange and in the area of the second front surface for fastening to a motor housing of the two-stroke motor, and with a second conduit segment formed in the flange, which second conduit segment is formed as a branch conduit that is accessible through the entrance opening of the first conduit segment and that comprises at least one exit opening.

In one embodiment a section of a conduit wall separates the branch conduit from the canal segment in such a manner that the throttle flap of the carburetor essentially strikes the conduit wall when the carburetor is connected to the flange when the position of the throttle flap is approached to a fully open position.

The branch conduit is split into at least two arms that run to an exit opening formed preferably in a jacket surface of the flange. The flange comprises at least one non-return valve arranged in the branch conduit in such a manner that it opens when the pressure on the side of the non-return valve facing the conduit segment exceeds the pressure on the side facing the exit opening of the branch conduit, and closes when the pressures compensate one another or the pressure in the conduit segment drops below the pressure in the branch conduit. The flange is provided for connecting a fresh-gas conduit in the area of the exit opening on the flange that conducts fresh gas from the flange to at least one associated overflow conduit.

Two exemplary embodiments of the invention are explained in the following with reference made to the attached drawings.

Figure 2:
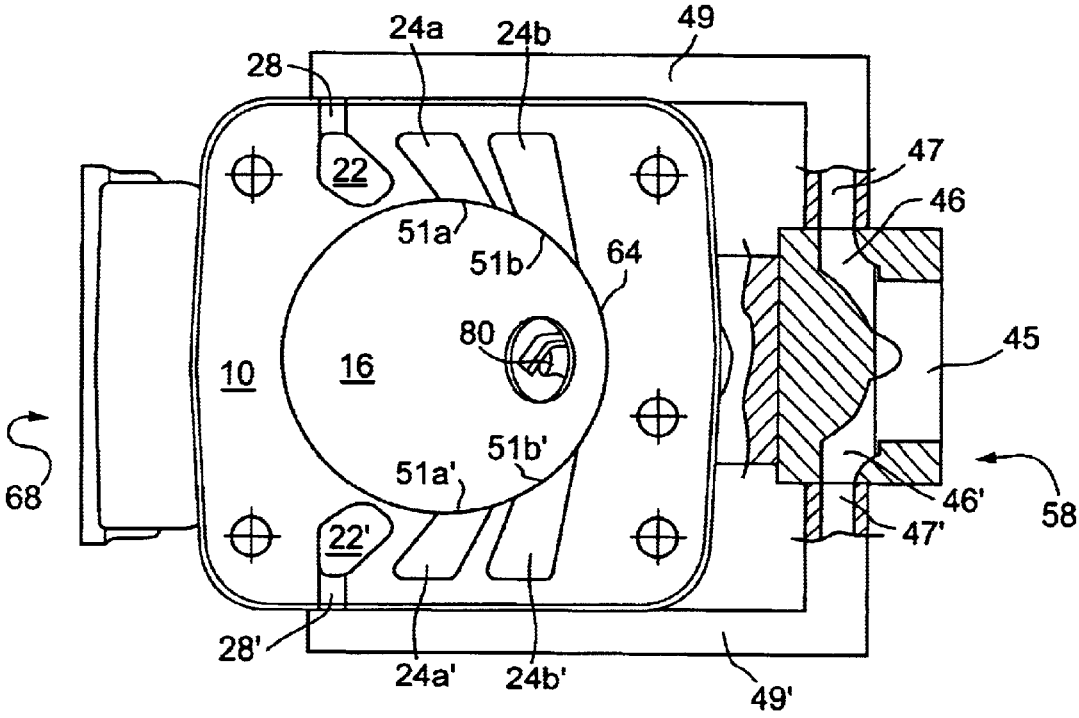
FIG. 2 shows a cross-sectional view of the two-stroke motor of FIG. 1.
Figure 3:
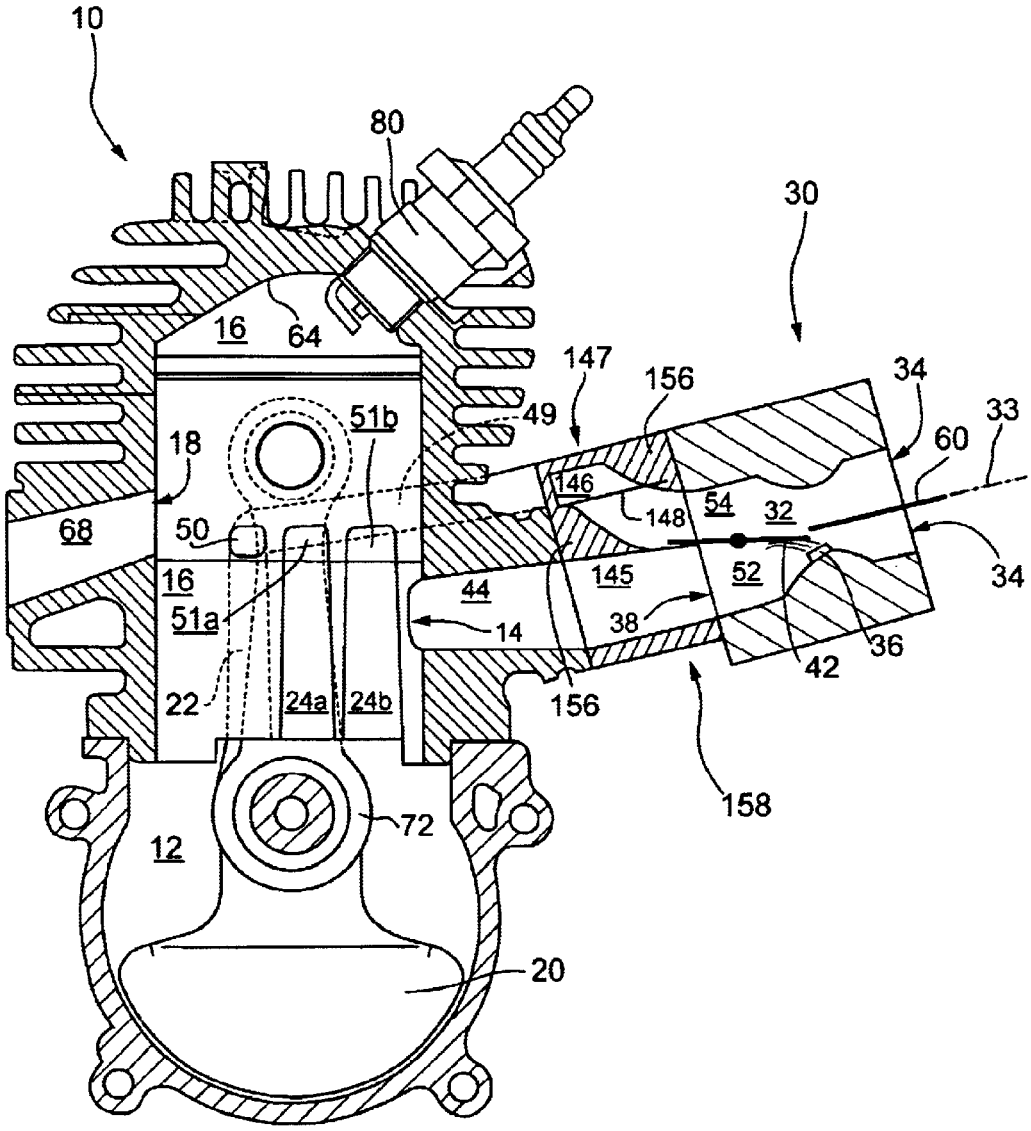
FIG. 3 shows a sectional lateral view of a two-stroke motor in accordance with a second exemplary embodiment.

The two-stroke motor shown in FIGS. 1 to 3 comprises carburetor 30, flange 58 and motor housing 10. Carburetor 30 comprises starter flap 60, carburetor chamber 32 and throttle flap 42. Starter flap 60 and throttle flap 42 are supported in a regulatable and rotatable fashion. The axis of rotation runs at a right angle to longitudinal axis 33 of carburetor chamber 32. In FIG. 1 starter flap 60 and throttle flap 42 are rotated into a fully open position. In the fully open position starter flap 60 and throttle flap 42 are located in a bisecting plane of carburetor chamber 32 with longitudinal axis 33.

Carburetor chamber 32 comprises fresh-air entrance opening 34 through which fresh air from an air filter (not shown) can enter into carburetor chamber 32. A fuel entrance opening is designed as fuel nozzle 36 in the wall of carburetor 30. Carburetor chamber 32 is constricted in the area of fuel nozzle 36. Fuel entering through fuel nozzle 36 into carburetor chamber 32 can be entrained especially well by fresh air flowing through carburetor chamber 32. Mixture exit opening 38 is formed opposite fresh-air entrance opening 34.

In the fully open position throttle flap 42 and starter flap 60 form a separating wall in the bisecting plane of carburetor chamber 32. Mixture chamber section 52 with fuel nozzle 36 is substantially separated in this position of starter flap 60 and throttle flap 42 from fresh-air chamber section 54 of carburetor chamber 32.

Motor housing 10 comprises crank chamber 12 and cylinder chamber 16. Crank drive 20 is located in crank chamber 12, which crank drive is movably connected by connecting rod 72 to piston 70 in cylinder chamber 16. Inlet conduit 44 is formed in motor housing 10 which conduit empties through inlet opening 14 into the interior of motor housing 10. When piston 70 is close to the upper top dead center a gas can pass from inlet conduit 44 through inlet opening 14 into crank chamber 12. A pair of two hook-shaped overflow lines 22, 22' that are symmetric with one another is connected to motor housing 10, which overflow lines form a first overflow conduit. Furthermore, two overflow lines 24*a*, 24*a*' of a second overflow conduit and two overflow lines 24*b*, 24*b*' of a third overflow conduit that are all symmetric to one another in pairs are formed in motor housing 10. Overflow lines 22, 22'; 24*a*, 24*a*' and 24*b*, 24*b*' have entrances in the area of crank chamber 12 and empty into cylinder chamber 16. Mouths 50, 50' of overflow lines 22, 22' as well as mouths 51*a*, 51*a*'; 51*b*, 51*b*' of overflow lines 42*a*, 24*a*' and 24*b*, 24*b*' are formed in wall 64 of cylinder chamber 16 in such a manner that they are free when piston 70 is at the bottom dead center. Furthermore, outlet opening 18 is formed in wall 64 of cylinder chamber 16 and outlet conduit 68 runs from outlet opening 18 to an exhaust system (not shown). Outlet opening 18 is formed in wall 64 of cylinder chamber 16 in such a manner that it is free when piston 70 is at the bottom dean center. A mounting that receives spark plug 80 is formed in a cover section of wall 64 of cylinder chamber 16.

Flange 58, 158 is designed essentially as a chamber-like conduit segment 45, 145 with an entrance opening facing away from motor housing 10 and with an exit opening facing motor housing 10. Flange 58 is fastened to motor housing 10 in such a manner that conduit segment 45, 145 forms a prolongation of inlet conduit 44.

In the first exemplary embodiment shown in FIG. 1 a branch conduit 46 is formed with an entrance opening in conduit wall 56 and two exit openings 47, 47' in the jacket surface of flange 58. It becomes clear in the top view shown in FIG. 2 that branch conduit 46 is formed in flange 58 in such a manner that it comprises two arm sections that extend radially from a chamber section of the branch conduit and run to exit openings 47 and 47'.

Furthermore, non-return valve 48, 148 is arranged in branch conduit 46, 146. Non-return valve 48, 148 opens when the pressure in conduit segment 45, 145 exceeds the pressure in branch conduit 46, 146 and closes when the pressures compensate one another or the pressure in branch conduit 46, 146 exceeds the pressure in conduit segment 45, 145.

Carburetor 30 is connected to the side of flange 58, 158 facing away from motor housing 10 is such a manner that carburetor chamber 32 forms a prolongation of conduit segment 45, 145 in the area of mixture exit opening 38. Furthermore, hook-shaped fresh-gas line 49, 49' of a fresh-gas conduit is connected to flange 58, 158 in the area of exit openings 47, 47' of branch conduit 46, 146. Fresh-gas line 49, 49' empties through fresh-gas opening 28, 28' into overflow line 22, 22'. Fresh-gas opening 28, 28' is arranged in the immediate vicinity of mouth 50, 50' of overflow line 22, 22' in cylinder chamber 16.

In the second exemplary embodiment shown in FIG. 3 branch conduit 146 is formed with an entrance opening in the front surface of flange 158 facing carburetor 30 and with two exit openings 147, 147' in the jacket surface of flange 148. A section of conduit wall 156 is formed in flange 158 in such a manner that conduit wall 156 substantially separates branch conduit 146 from conduit segment 145. The section of conduit wall 156 extends from the side facing motor housing 10 through flange 148 approximately to the side of flange 148 facing away from motor housing 10 on which side carburetor 30 is connected to flange 148. Carburetor 30 is connected to flange 148 in such a manner that a common cross section of conduit segment 145 and of branch conduit 146 follows mixture exit opening 38 of carburetor chamber 32. In its fully open position throttle flap 42 strikes conduit wall 156 in the carburetor.

A working cycle of the two-stroke motor shown in FIGS. 1, 2 and 3 is described in the following.

A working cycle takes place in the two-stroke motor during a revolution of crank drive 20. The working cycle consists of drawing in, compressing, working, emitting. Cylinder chamber 16 cooperates with crank chamber 12 in the working cycle. Crank chamber 12 forms a pump together with a section of cylinder chamber 16 following crank chamber 12 and with piston 70.

During a first stroke piston 70 moves from a bottom dead center to a top dead center; piston 70 is shown in FIGS. 1, 3 in the position at the top dead center. Piston 70 closes mouths 50, 50'; 51*a*, 51*a*'; 51*b*, 51*b*' of overflow lines 22, 22'; 24*a*, 24*a*'; 24*b*, 24*b*'. A vacuum (preliminary drawing in) is produced in crank chamber 12. When piston 70 reaches a position in the vicinity of the top dead center it frees inlet opening 14 of inlet conduit 44. Crank chamber 12 draws fresh gas in that is located in inlet conduit 44. Simultaneously with mouths 50, 50'; 51*a*, 51*a*'; 51*b*, 51*b*' piston 70 closes outlet opening 18 of outlet conduit 68 running to the exhaust system (not shown). Piston 70 builds up a pressure in cylinder chamber 16 during the further travel to the top dead center. An air-fuel mixture located in cylinder chamber 16 is compressed thereby. When piston 70 has almost reached the top dead center, spark plug 80 is ignited and the air-fuel mixture burned to a waste gas.

The waste gas works during a second stroke [cycle] and moves piston 70 from the top dead center to the bottom dead center. Piston 70 closes inlet opening 14 during the travel to the bottom dead center and compresses the fresh gas in crank chamber 12 that had been previously drawn in. At the same time piston 70 opens outlet opening 18 to outlet conduit 68 as well as mouths 50, 50' ; 51*a*, 51*a*' ; 51*b*, 51*b*' of overflow lines 22, 22' and 24*a*, 24*a*' and 24*b*, 24*b*'. The pre-compressed fresh gas in crank chamber 12 penetrates into overflow lines 22, 22', 24*a*, 24*a*', 24*b*, 24*b*' and pushes a fresh-gas supply out of overflow lines 22, 22' of the first overflow conduit through mouths 50, 50' as well as an air-fuel mixture out of overflow lines 24*a*, 24*a*' and 24*b*, 24*b*' of the second and of the third overflow conduit through mouths 51*a*, 51*a*' and 51*b*, 51*b*' into cylinder chamber 16. The fresh-gas supply and the air-fuel mixture scavenge cylinder chamber 16 and push the waste gas through outlet opening 18 into outlet conduit 68, further into the exhaust and finally into the ambient. Furthermore, a part of the fresh-gas supply passes in the manner of a short circuit directly from mouths 50, 50' to outlet opening 18. Stored fresh air escapes thereby almost exclusively in fresh-gas conduits 49, 49'.

Starter flap 60 is fully open in carburetor chamber 32 of carburetor 30 when the two-stroke motor is warm. At full performance throttle flap 42 is also fully open. Starter flap 60 and throttle flap 42 are rotated in their fully open position by approximately one right angle out of the closed position in such a manner that they are in the same plane that separates carburetor chamber 32 in the longitudinal direction into mixture chamber section 52 and fresh-air chamber section 54. In this position starter flap 60 and throttle flap 42 jointly form a separating wall that substantially separates mixture chamber section 52 and fresh-air chamber section 54 from one another.

While the vacuum prevails in crank chamber 12 and the inlet opening is free, fresh air flows through fresh-air entrance opening 34 into carburetor chamber 32. A first volume section of the air current flows through mixture chamber section 52 and entrains fuel entering in the area of fuel nozzle 36 into carburetor chamber 32 in such a manner that an air-fuel mixture is produced. A second volume section of the air current flows through fresh-air chamber section 54. Only slight turbulence of the air-fuel mixture of the first volume section with the fresh air of the second volume section occurs in the area of mixture exit opening 38 as well as downstream in conduit segment 45, 145 of flange 58, 158. The first volume section passes with the air-fuel mixture into crank chamber 12. The second volume section with the fresh air branches off at least partially into branch conduit 46, 146. When the pressure in fresh-gas lines 49, 49' of the fresh-gas conduit is less than in branch conduit 46, 146 non-return valve 48, 148 opens and the fresh air is drawn into fresh-gas lines 49, 49'. (Upon a reversal of the pressure difference or at the same pressure non-return valve 48, 148 closes the path from fresh-gas lines 49, 49' to branch conduit 46, 146). The second volume section with the fresh air then passes through fresh-gas lines 49, 49' and fresh-gas openings 28, 28' as fresh-gas supply into overflow lines 22, 22' of the first overflow conduit. After the scavenging of cylinder chamber 16 with the fresh-gas supply from overflow lines 22, 22' a part of the fresh gas passes into the ambient (short-circuit losses). Due to the small amount of fuel in the fresh gas few unburned fuel components pas into the exhaust gas, which is therefore particularly low in pollutants.

In order to throttle the performance of the two-stroke motor throttle flap 42 in moved into a middle position in which it approximately bisects, e.g., a right angle to the bisecting plane for its part. In this position turbulence of the first volume section flowing through carburetor chamber 32 occurs with the air-fuel mixture and with the second volume section with the fresh air during which the fresh air is contaminated by a moderate admixture of fuel. The second volume section with the contaminated fresh air branches off at least partially into branch conduit 46, 146 and passes through fresh-gas lines 49, 49' of the fresh-gas conduit as fresh-gas supply into overflow lines 22, 22' of the first overflow conduit. After the scavenging of cylinder chamber 16 with the fresh-gas supply from overflow lines 22, 22' a part of the fresh gas passes into the ambient (short-circuit losses). Due to the moderate amount of fuel in the fresh gas little unburned fuel components pass into the exhaust gas, which is therefore especially low in pollutants. Another part of the fresh gas that has a higher amount of fuel remains in cylinder chamber 16 and burns the air-fuel mixture so that a uniform running of the two-stroke motor is assured even at low speeds.

In the second embodiment of the two-stroke motor of the invention shown in FIG. 3 conduit wall 156 in flange 158, which wall separates conduit segment 145 from branch conduit 146, is prolonged so far in the direction of carburetor 30 that throttle flap 42 strikes against conduit wall 156 in the fully open position. Therefore, in this embodiment the second volume section of the fresh air flowing through carburetor chamber 32 passes substantially completely into branch conduit 146 when throttle flap 42 is in the fully open position. The two-stroke motor then runs with very few pollutants because the fresh-gas supply pushed after the scavenging of cylinder chamber 16 unburned into the ambient contains only very low or no fuel components.

What is claimed is:

1. A two-stroke motor with a fresh-gas supply, comprising a motor housing which comprises a crank chamber having an inlet opening and a cylinder chamber having an outlet opening, wherein the crank chamber comprises a crank drive and the cylinder chamber comprises a piston, which crank drive and piston are connected by a connecting rod, at least one overflow conduit, a carburetor comprising a carburetor chamber that comprises a fresh-air entrance opening, a fuel entrance opening and a mixture exit opening, a regulatable throttle flap, an inlet conduit connecting the mixture exit opening and the inlet opening of the crank chamber, and a fresh-gas conduit comprising an opening to the overflow conduit, wherein the fresh-gas conduit and the carburetor chamber are connected in such manner that the throttle flap is controllable and the direct supply of fresh gas to the overflow conduit is controlled thereby, wherein the throttle flap can be brought into a first open position in which the throttle flap is fully open and separates the carburetor chamber at least partially into a mixture chamber section with the fuel entrance opening and into a fresh-air chamber section, wherein a starter flap is positioned in close proximity to the fresh-air entrance opening of the carburetor chamber, which starter flap is adjustable so that when it is in a fully open position it is essentially in a plane with the throttle flap when the throttle flap assumes the first open position.

2. The two-stroke motor according to claim 1, which has oil-in-gasoline lubrication.

3. The two-stroke motor according to claim 1, characterized in that the throttle flap is positioned in close proximity to the mixture exit opening.

4. The two-stroke motor according claim 1, which further comprises a non-return valve that comprises a first side facing the opening to the overflow conduit and a second side facing the carburetor chamber, which non-return valve closes communication between the carburetor chamber and the overflow conduit when pressure on the first side of the non-return valve facing the opening to the overflow conduit exceeds or equals the pressure on the second side facing the carburetor chamber.

5. The two-stroke motor according to claim 4, characterized in that the non-return valve comprises at least one leaf spring, the intrinsic tension of which is minimized in a closed position.

6. The two-stroke motor according to claim 5, characterized in that the leaf spring is positioned so that it substantially forms a wall section of the inlet conduit in the closed position.

7. The two-stroke motor according to claim 1, wherein the carburetor chamber further comprises at least one separating element that is positioned in the carburetor chamber to support the separating action of the throttle flap in the first open position.

8. The two-stroke motor according to claim 1, characterized in that the throttle flap can be brought into at least one second open position in such a manner that the separation of the mixture chamber section from the fresh-air chamber section is reduced the more the second open position of the throttle flap approaches a closed position.

9. The two-stroke motor according to claim 1, which further comprises a flange positioned in close proximity to the inlet conduit, wherein the flange is connected to the carburetor and comprises a conduit segment and a branch conduit.

10. The two-stroke motor according to claim 9, wherein the carburetor chamber further comprises at least one separating element that is positioned in the carburetor chamber to support the separating action of the throttle flap in the first open position, and wherein in the first open position the throttle flap contacts a section of the wall of the branch conduit and/or the separating element, which section of the branch conduit wall or which separating element separates the branch conduit from the conduit segment, and wherein the throttle flap forms a section of a separating wall.

11. The two-stroke motor according to claim 1, wherein the overflow conduit comprises a opening which is formed at the level of the same axial section of the cylinder chamber as the mouth of the overflow conduit into the cylinder chamber.

12. The two-stroke motor according claim 1, characterized in that the overflow conduit empties into the cylinder chamber in close proximity to the outlet opening of the cylinder chamber.

13. The two-stroke motor according to claim 1, wherein the overflow conduit comprises a pair of overflow lines symmetric to one another, and wherein the fresh-gas conduit comprises a pair of fresh-gas lines, each of which is connected to an overflow line.

14. The two-stroke motor according to claim 13, wherein the overflow lines have hook-type shapes.

15. The two-stroke motor according to claim 1, which further comprises at least one second overflow conduit comprising overflow lines that are symmetrically connected to one another, which overflow lines connect the crank chamber to the cylinder chamber and empty into the cylinder chamber.

16. The two-stroke motor according to claim 1, which further comprises at least one non-return valve, and wherein the fresh-gas conduit comprises a fresh-gas line, wherein the non-return valve is connected to the fresh-gas line.

17. A flange for a two-stroke motor with fresh-gas supply, wherein the flange comprises a first front surface and a second front surface, a first conduit segment, and a second conduit segment, wherein the motor comprises a motor housing which comprises a crank chamber having an inlet opening and a cylinder chamber having an outlet opening, wherein the crank chamber comprises a crank drive and the cylinder chamber comprises a piston, which crank drive and piston are connected by a connecting rod, at least one overflow conduit, a carburetor comprising a carburetor chamber that comprises a fresh-air entrance opening, a fuel entrance opening and a mixture exit opening, a regulatable throttle flap, an inlet conduit connecting the mixture exit opening and the inlet opening of the crank chamber, and a fresh-gas conduit comprising an opening to the overflow conduit, wherein the fresh-gas conduit and the carburetor chamber are connected in such manner that the throttle flap is controllable and the direct supply of fresh gas to the overflow conduit is controlled thereby, wherein the throttle flap can be brought into a first open position in which the throttle flap is fully open and separates the carburetor chamber at least partially into a mixture chamber section with the fuel entrance opening and into a fresh-air chamber section, wherein a starter flap is positioned in close proximity to the fresh-air entrance opening of the carburetor chamber, which starter flap is adjustable so that when it is in a fully open position it is essentially in a plane with the throttle flap when the throttle flap assumes the first open position, wherein the first conduit segment extends through the flange and comprises an entrance opening in the first front surface and an exit opening in the second front surface, and the flange is fastened to the carburetor by the first front surface and is fastened to the motor housing by the second front surface, wherein the second conduit segment comprises a branch conduit that comprises at least one exit opening, which branch conduit is accessible through the entrance opening of the first conduit segment.

18. The flange according to claim 17, wherein the two-stroke motor has oil-in-gasoline lubrication.

19. The flange according to claim 17, which further comprises a conduit wall that separates the branch conduit from the first conduit segment in such a manner that the throttle flap strikes the conduit wall when the carburetor is connected to the flange and the throttle flap is in or near a fully open position.

20. The flange according to claim 17, which further comprises a jacket surface, wherein the branch conduit is split into at least two arms that run to an exit opening in the jacket surface.

21. The flange according claim 17, wherein the branch conduit comprises a non-return valve that comprises a first side facing the first conduit segment and a second side facing the exit opening of the branch conduit, which non-return valve opens when pressure on the first side exceeds pressure on the second side, and closes when pressure in the first conduit segment equals or is less than the pressure in the branch conduit.

22. The flange according to claim 17, wherein the motor further comprises a fresh-gas conduit comprising at least one fresh-gas line connected to an overflow line, wherein the flange connects the at least one fresh-gas line to the exit opening of the first conduit segment.

* * * * *